United States Patent [19]

Yoshida

[11] Patent Number: 4,888,839

[45] Date of Patent: Dec. 26, 1989

[54] METHOD AND APPARATUS FOR TREATING ELONGATE TEXTILE MATERIALS

[75] Inventor: Hiroshi Yoshida, Kurobe, Japan

[73] Assignee: Yoshida Kogyo K. K., Tokyo, Japan

[21] Appl. No.: 281,284

[22] Filed: Dec. 8, 1988

[30] Foreign Application Priority Data

Dec. 17, 1987 [JP] Japan ..... 62-321007

[51] Int. Cl.[4] ..... D06B 3/09; D06B 23/04

[52] U.S. Cl. ..... 8/149.1; 8/154; 68/5 C; 68/10; 68/15; 68/171

[58] Field of Search ..... 8/149.1, 154, 155, 155.2; 68/5 C, 8, 10, 15, 27, 152, 153, 171, 172, 173

[56] References Cited

U.S. PATENT DOCUMENTS 3,938,952 2/1976 McNeill ..... 68/152 X
4,164,050 8/1979 Stakelbeck ..... 8/149.1
4,206,619 6/1980 Fukuroi et al. ..... 68/20
4,393,671 7/1983 Ito ..... 68/5 C

FOREIGN PATENT DOCUMENTS 1195517 5/1959 France ..... 68/5 C
528867 3/1977 Japan .

*Primary Examiner*—Philip R. Coe
*Attorney, Agent, or Firm*—Hill, Van Santen, Steadman & Simpson

[57] ABSTRACT

An elongate textile material liquid-permeably wound on a bobbin and a treatment liquid are enclosed in a container with a gaseous phase portion remaining within the container. The container is conveyed through an elongate heating bath for heating the treatment liquid at a predetermined temperature. During conveyance, the container is rotated to cause the textile material to move alternately through the treatment liquid and the gaseous phase portion within the container.

30 Claims, 9 Drawing Sheets

METHOD AND APPARATUS FOR TREATING ELONGATE TEXTILE MATERIALS

BACKGROUND OF THE INVENTION

1. Field of the Invention

The present invention relates to a method of and an apparatus for treating elongate textile materials such as continuous fabric tapes including slide fastener chains or stringer tapes, webs, ribbons, fiber strands, fiber yarns, etc. through a processing step such as dyeing, bleaching, scouring, glazing or alkaline weight-reduction.

2. Description of the Prior Art

In the manufacture of textile articles, an elongate textile material is subjected to a series of treatments including dyeing. In general, there are known three dyeing methods or systems, i.e. the cheese-dying, beam-dyeing and continuous dyeing. One example of the beam-dyeing is disclosed in Japanese Patent Publication No. 58-5301, in which a treatment liquid is circulated by a pump to first flow into the interior space of a perforated hollow cylindrical beam, then penetrate successively through perforations or pores in the beam and an elongate textile material wound around the outer wall of the beam, and finally return to the pump.

Japanese Patent Publication No. 52-8867 discloses an example of the continuous-dyeing system in which an elongate textile material of polyester is continuously fed through a series of treatment stations including a dye bath for dye application, a steam box for steam-heating, a dry box for drying, a baking box for color development, and water washing baths for finishing.

The foregoing known dyeing systems are particularly suitable for the mass production of textile articles but they do not show any commercial success when used for the production of various kinds of articles in small quantities at a relatively short production cycle. Another problem is that the color reproducibility between different batches or lots of treated articles is unstable.

SUMMARY OF THE INVENTION

It is accordingly an object of the present invention to provide a method of and an apparatus for treating an elongate textile material which is suitable for the production of various kinds of textile articles in small quantities and is capable of treating different kinds of elongate textile material continuously and uniformly at a relatively short production cycle without the necessity of a long downtime for setting the apparatus.

According to a first aspect of the present invention, there is provided a method of treating an elongate textile material with a treatment liquid, comprising the steps of: sealingly holding in a container an elongate textile material to be treated which is liquid-permeably wound on a bobbin and a treatment liquid while keeping a gaseous phase portion within the container; and conveying the container longitudinally through an elongate high-temperature treatment zone to heat the treatment liquid at a predetermined temperature while rotating the container together with the bobbin held therein to cause the textile material to move alternately through the treatment liquid and the gaseous phase portion within the container, thereby treating the textile material with the treatment liquid.

According to a second aspect of the present invention, there is provided an apparatus for treating an elongate textile material with a treatment liquid, comprising:

a bobbin for winding thereon an elongate textile material and having a liquid-permeable structure; a container for sealingly holding therein the bobbin and a treatment liquid with a gaseous phase portion kept within the container, the bobbin being immovably held within the container; means defining an elongate high-temperature treatment zone; a conveyor device for conveying the container longitudinally through the elongate high-temperature zone for heating said treatment liquid at a predetermined temperature; and a rotating device for rotating the container to cause the textile material to move alternately through said treatment liquid and said gaseous phase portion while said conveyor is being conveyed by said conveyor device.

Many other advantages and features of the present invention will become manifest to those versed in the art upon making reference to the detailed description and the accompanying sheets of drawings in which preferred structural embodiments incorporating the principles of the present invention are shown by way of example.

DETAILED DESCRIPTION

Figure 1:
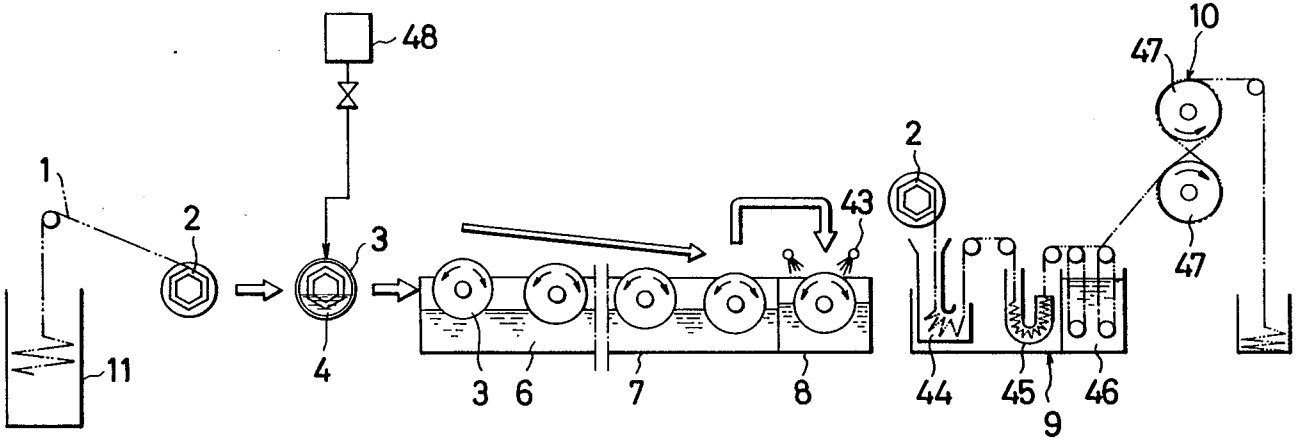
FIG. 1 is a diagrammatic view showing a series of processing steps for dyeing an elongate textile material according to the present invention.

FIG. 1 diagrammatically shows a method of dyeing an elongate textile article according to the present invention.

According to the illustrated method, an elongate textile material 1 to be dyed is relatively loosely wound around a bobbin 2 until a predetermined number of turns of the textile material 1 are retained on the bobbin 2. The textile material thus wound untightly has an increased degree of permeability to a dye liquor. After the bobbin 2 is received in a cup-shaped body of a container 3, an end cap or cover 5 (FIG. 3) is connected to an open end of the container body to close the container 3. In this instance, the bobbin 2 is concentrically non-rotatably retained within the container 3. Then, a metered amount of dye liquor 4 is supplied into the container 3. The amount of the dye liquor 4 is determined by the amount of the textile material 1 to be dyed. In this instance, however, the amount of dye liquor is smaller than the volume of the container 3 such that a space or gaseous phase portion always remains in the container 3. The bobbin 2 has a perforated hollow structure so that the dye liquor 4 in the container 3 is permitted to flow through the textile material 1 and pores in the bobbin 2 into the inside of the hollow bobbin 2. More particularly, a perforated hollow cylindrical bobbin 2 having a polygonal cross-sectional shape is preferable because the dye liquor 4 is uniformly stirred by side edges of the polygonal bobbin as the latter is rotated together with the container 3 as described later on.

Thereafter, the closed container 3 is introduced into the inlet end of an elongate heating bath 7 containing a heating medium 6 such as polyethylene glycol, for example, then fed either continuously or intermittently at a predetermined cycle time toward the outlet end of the heating bath 7. During that time, the vertical position of the container 3 is varied relative to the level of the heating medium 6 to thereby adjust the surface area of the container 3 immersed in the heating medium 6. At the same time, the container 3 while being fed longitudinally along the heating bath 7 is rotated about its own axis in one direction or alternately in forward and reverse directions at a suitable cycle time. With this rotation of the container 3, the container 3 itself and hence the dye liquor 4 retained therein is heated efficiently. At the same time, the thus heated dye liquor 4 is distributed uniformly over the entire surface of the textile material 1 wound on the bobbin 2 as the textile material 1 move alternately through the dye liquor 4 and the gaseous phase portion within the container 3. After the lapse of a predetermined period of time, the container 3 is set to arrive the outlet end of the heating bath 7 whereupon a dyeing process is completed.

Thereafter, the container 3 is removed from the heating bath 7, then immersed into a cooling bath 8 to cool the dyed textile material 1. After the bobbin 2 is removed from the container 3, the textile material 1 is unwound from the bobbin 2 and introduced into a post-treatment bath 9 in which the dyed textile material 1 is washed and subjected to a post-treatment. Finally, the textile material 1 is dried by a dryer 10. The thus-finished textile material is stored into a product container for sale or storage.

Figure 2:
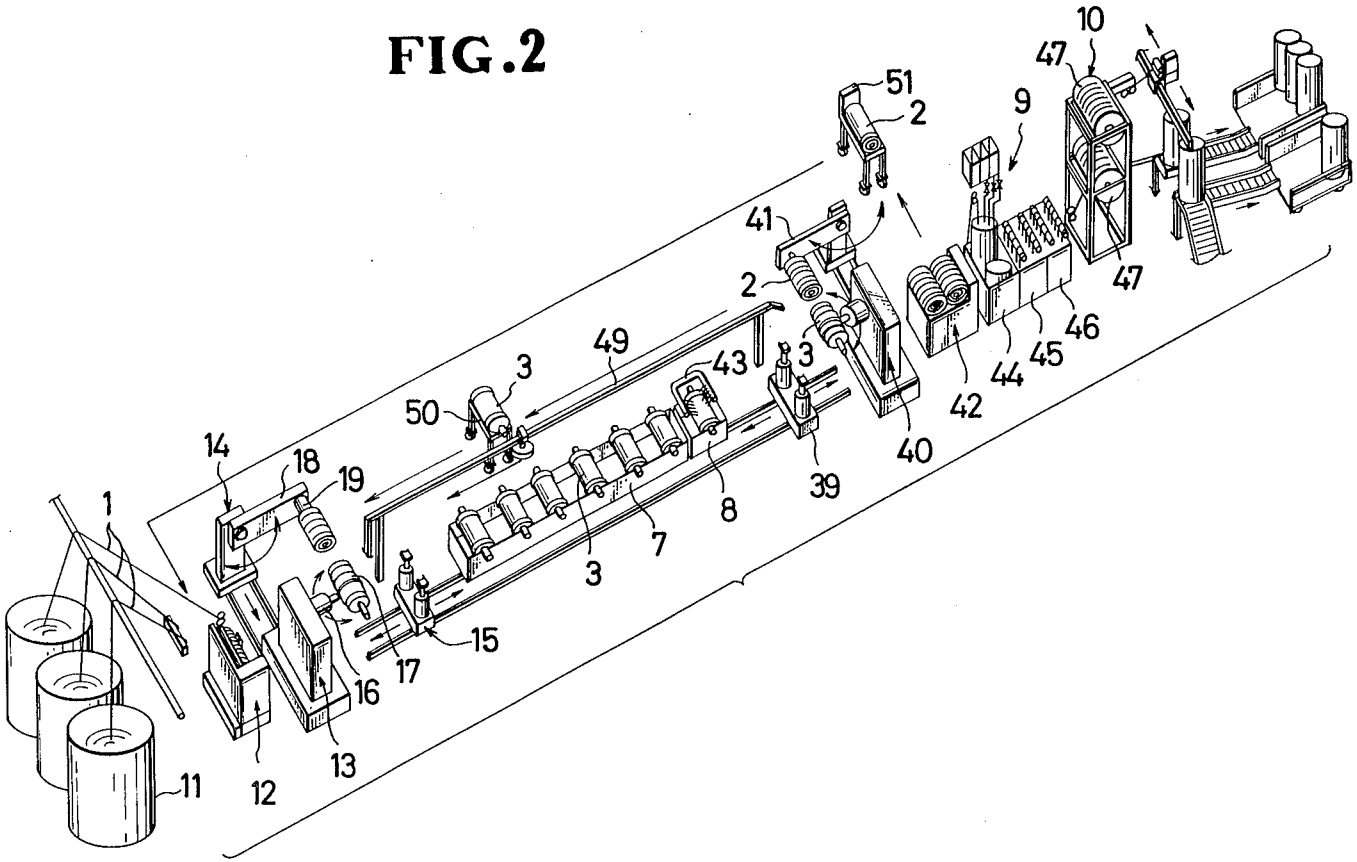
FIG. 2 is a schematic perspective view of an apparatus for achieving the processing steps shown in FIG. 1.

The method as stated above with reference to FIG. 1 is reduced into practice by an apparatus diagrammatically shown in FIG. 2.

The apparatus includes, at its supply side, at least one storage container (three in the illustrated embodiment) 11 for storing an elongate textile material 1 to be dyed or treated, a winder 12 for winding the textile material 1 on a bobbin (identical to the bobbin 2 shown in FIG. 4), a first container holder 13 for holding a container (identical to the container 3 shown in FIG. 3), a bobbin loader 14 for loading the bobbin into the container held by the container holder 13, and a loading carrier 15 for transferring the container with the bobbin loaded therein from the container holder 13 to the inlet end of the heating bath 7.

The container holder 13 includes a gripper 17 provided on the distal end of a rotatable arm 16 for releasably holding the container 3. The rotatable arm 16 is turned about its own axis to move the container 3 between a horizontal position shown in FIG. 2 and a vertical position in which the container 3 is disposed vertically. The bobbin loader 14 includes a pivot arm 18 having at its distal end a support portion 19 on which the bobbin 2 is horizontally supported. The pivot arm 18 is angularly movable between a first position in which the support portion 19 is held in alignment with the axis of the bobbin 2 held on the winder 12, and a second position in which the support portion 19 is held in alignment with the central axis of the container 3 held on the container holder 13. The bobbin loader 14 is reciprocally movable toward and away from the winder 12 and the container holder 13 for receiving the bobbin 2 from the winder 12 and then loading the same bobbin 2 in the container 3 supported on the container holder 13. The loading carrier 15 is reciprocally movable on and along a pair of rails (not designated) disposed one on each side of the heating bath 7 and extending longitudinally beyond the inlet and outlet ends of the heating bath 7. The loading carrier 15 includes a lift composed of a pair of parallel spaced vertical cylinders (not designated) for transferring the container 3 from the container holder 13 to the inlet end of the heating bath 7 as the loading carrier 15 reciprocates therebetween along the rails.

With this arrangement of the supply end of the apparatus, an elongate textile material 1 is wound on a bobbin 2 while the latter is revolved on the winder 12 until a predetermined number of turns are retained on the bobbin 2. Then the bobbin 2 is detached from the winder 12 by the bobbin loader 14 which in turn inserts the thus detached bobbin 2 into a container 3 horizontally held on the container holder 13. Thereafter a metered supply of dye liquor 4 is filled into the container 3 while the latter is held in the vertical position with its open end faced upwardly. The amount of dye liquor 4 is determined such that the textile material 1 wound around the bobbin 2 is efficiently dyed by the dye liquor 4, and a liquid phase portion and a gaseous phase portion exist concurrently in the container 3. The dye liquor 4 preferably has a bath ratio of 1:5–1:10. Then the container 3 is closed by a cover 5 in which instance the bobbin 2 is held immovably within the container 3 in concentrical relation to the latter. After the container 3 is moved from the vertical position to the horizontal position, it is retained on the lift of the loading carrier 15 and then transferred to the inlet end of the heating bath 7.

Figure 3:
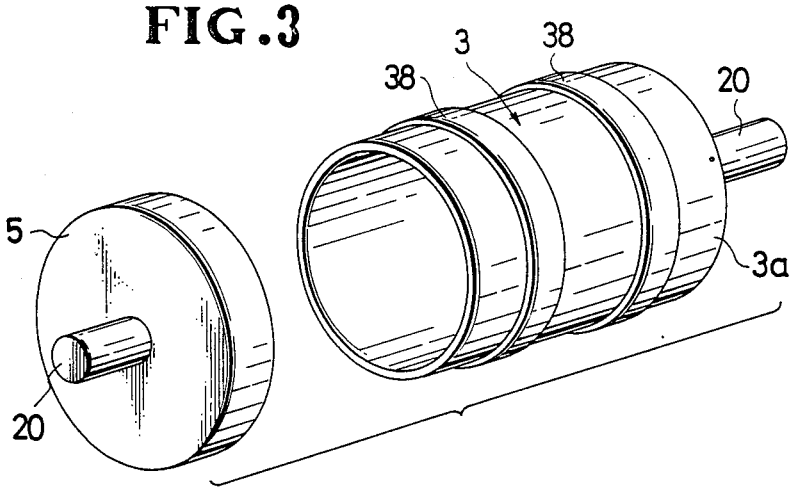
FIG. 3 is an exploded perspective view of a container incorporated in the apparatus shown in FIG. 2.

The container 3, as shown in FIG. 3, is composed of a cup-shaped body 3*a* of a corrosion-resistant metal, and a detachable cover 5 releasably connected to an open end of the container body 3*a* to close the same. The container body 3*a* and the cover 5 have coaxial support shafts 20, 20 projecting outwardly from end walls, respectively, o the container body 3*a* and the cover 5. The container body 3*a* has a pair of parallel spaced reinforcing rings 38, 38 formed integrally with an outer peripheral surface of the container body 3*a*.

Figure 4:
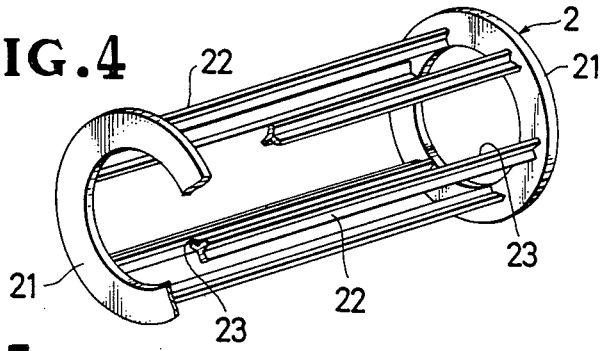
FIG. 4 is a perspective view of a bobbin with parts cut-away for clarity.
Figure 5:
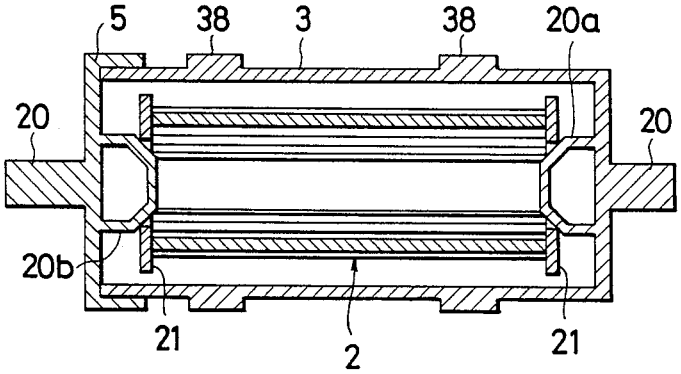
FIG. 5 is a longitudinal cross-sectional view showing the bobbin held in the container.

The bobbin 2, as shown in FIG. 4, includes a pair of opposed circular ring plates 21, 21 and a plurality of support bars 22 extending between and interconnecting the ring plates 21, 21, the support bars 22 being circumferentially spaced at equal angular distances. Each of the support bars 22 has a Y-shaped cross section and includes three splashing fins 23 for splushing the dye liquor while the bobbin 2 is rotated concurrently with the rotation of the container 3 as described later on. The textile material 1 (FIGS. 1 and 2) is wound around the support bars 22. The bobbin 2 is concentrically held in the container 3 as shown in FIG. 5, in which instance the ring plates 21, 21 are firmly retained on a pair of opposed retainer projections 20*a*, 20*b* extending inwardly from the end walls of the container body 3*a* and cap 5. The bobbin 2 may be replaced with a perforated hollow cylindrical bobbin having in its peripheral wall a number of pores or perforations.

The heating bath 7 is in the shape of an elongate box and retains therein a heating medium 6 composed of a polyethylene glycol solution or the like. The heating bath 7 is provided with a heating unit 24, a conveyor device 25 and a rotating device 26 illustrated in FIGS. 6, 7 and 8, respectively.

Figure 6:
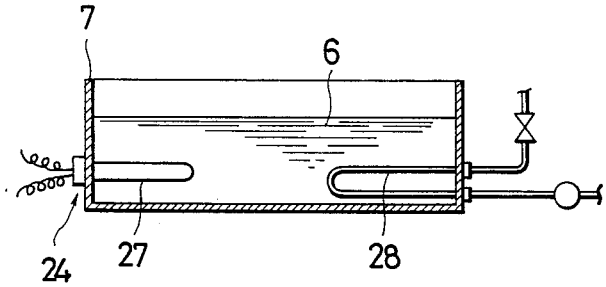
FIG. 6 is a schematic cross-sectional view of a heating bath constituting a part of the apparatus shown in FIG. 2, the view showing the arrangement of a heating unit.

As shown in FIG. 6, the heating unit 24 includes an electric heater 27 and a steam heater 28 used alone or in combination for heating the heating medium 6 uniformly over the entire region thereof at a predetermined temperature under the control of a non-illustrated control unit.

Figure 7:
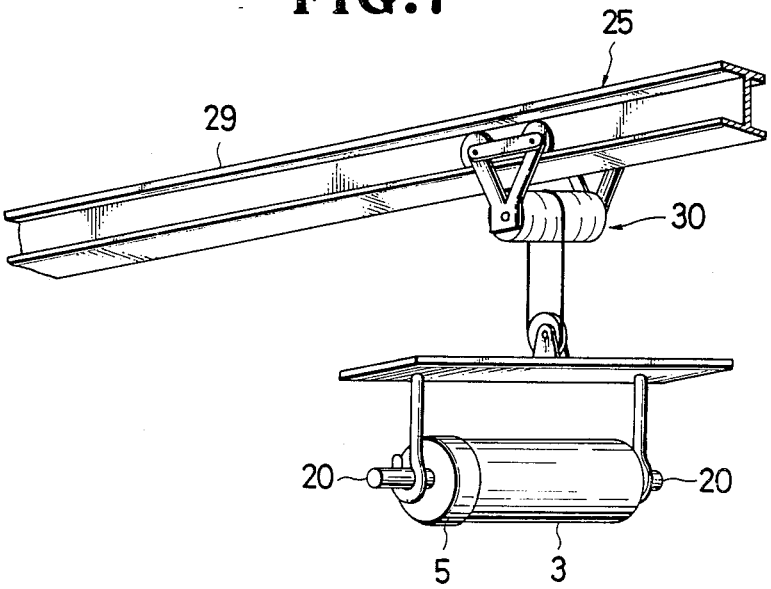
FIG. 7 is a schematic perspective view of a conveyor device incorporated in the apparatus shown in FIG. 2.

The conveyor device 25, as shown in FIG. 7, comprises a crane 30 movably supported on a horizontal rail 29 disposed along the heating bath 7 (FIG. 2) and extending longitudinally across the heating bath 7. The container 3 is horizontally suspended by the crane 30 of the conveyor device 25 and is transferred from the inlet end to the outlet end of the heating bath 7 while being at least partly immersed in the heating medium 6. During conveyance by the crane 30, the vertical position or height of the container 3 is adjusted relative to the surface of the heating medium 6, thereby varying the degree of immersion of the container 3. The conveyor device 25 may be replaced with a conveyor device 25*a* shown in FIG. 8, which conveyor device 25*a* comprising a pair of endless belt conveyors 31, 31 disposed on and extending along opposite sides of the heating bath 7 and supporting thereon the support shafts 20, 20 of the container 3. The conveyors 31, 31 have a varying height progressively reducing from the inlet end toward the outlet end of the heating bath 7. As an alternative, it is possible to use a conveyor device 25*b* shown in FIG. 9. The conveyor device 25*b* is composed of a pair of lifters 33, 33 each movably disposed on a pair of guide rails 32 disposed on and along one side of the heating bath 7. The container 3 is supported at its support shafts 20 on the lifters 33.

Figure 8:
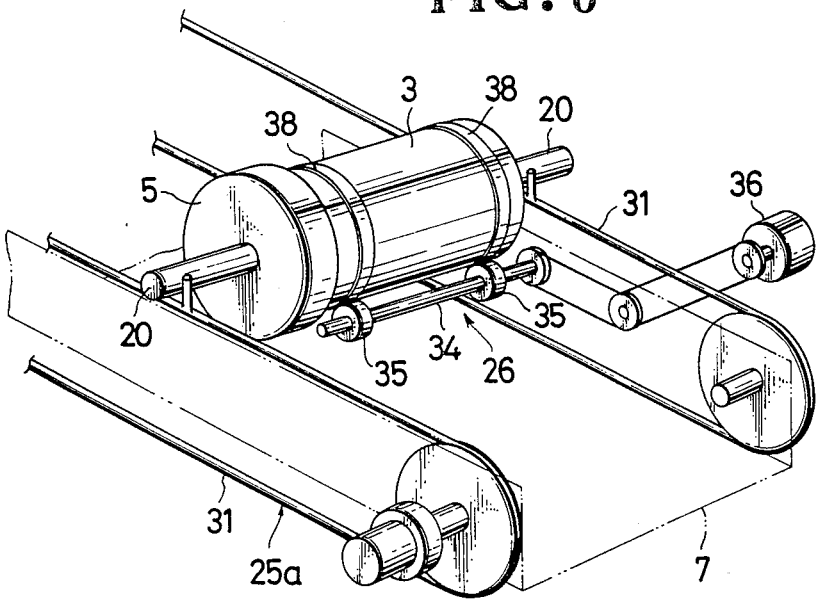
FIG. 8 is a view similar to FIG. 7, showing a modified conveyor device.
Figure 9:
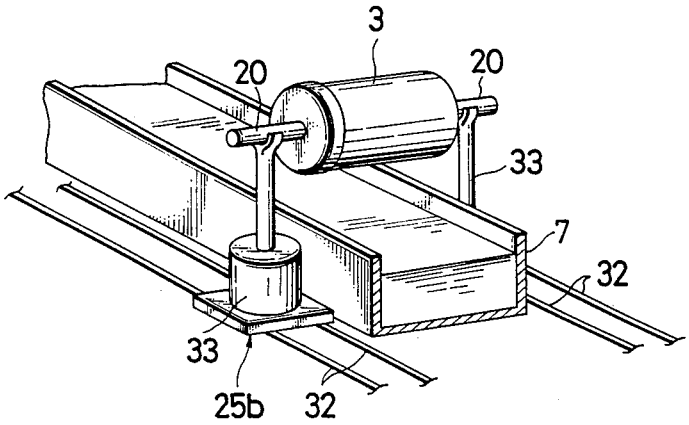
FIG. 9 is a view similar to FIG. 7, showing still another modified conveyor device.

The rotating device 26, as shown in FIG. 8, includes two laterally spaced drive rollers 35 secured to a support shaft 34 and held in frictional engagement with the reinforcing rings 38, 38, respectively, on the outer peripheral surface of the container 3 for rotating the container 3. The support shaft 34 is coupled in driven relation to the drive shaft of an electric motor 36 via conventional belt train (not designated). The reinforcing rings 38, 38 are provided to strengthen the cup-shaped container body 3*a* against deformation which would otherwise occur when the friction rollers 35 are forced against the outer peripheral surface of the container 3 to rotate the container 3.

Figure 10:
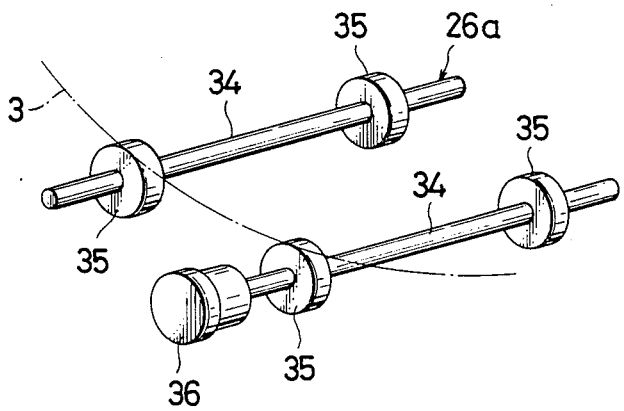
FIG. 10 is a schematic perspective view of a container rotating device which constitutes part of the apparatus shown in FIG. 2.
Figure 11:
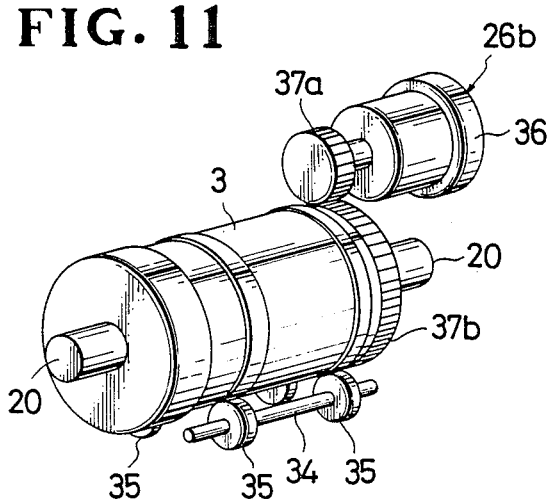
FIG. 11 is a view similar to FIG. 10, showing a modified container rotating device.

FIG. 10 shows a modified rotating device 26*a* which is different from the rotating device 26 shown in FIG. 8 in that the number of the support shaft 34 is two and one of the two support shafts 34, 34 is disposed on one side of the container 3 and directly connected with the drive shaft of an electric motor 36. The other of the support shafts 34 is freely rotatably disposed on the opposite side of the container 3. A further modified form of the rotating device is shown in FIG. 11. The modified device 26*b* is composed of a drive gear 37*a* driven by an electric motor 36, and a driven gear 37*b* secured to one of the support shafts 20 of the container 3 and held in mesh with the drive gear 37*a*. In combination with the gear-type rotating device 26*b*, friction rollers 35 such as shown in FIG. 10 may be employed for supporting the container 3. In this instance, however, the support shaft 34 is not positively driven to rotate the two friction rollers 35 secured thereto but freely rotatably supported. It is further possible to arrange the support shafts 34 horizontally movable toward and away from each other, thereby varying the supporting height of the container 3 relative to the surface of the heating medium 6. Alternately, the support shafts 34 may be movable vertically to adjust the vertical position of the container 3.

As shown in FIG. 2, the apparatus includes, at its discharge side, the cooling bath 8 disposed immediately downstream of the outlet end of the heating bath 7, an unloading carrier 39, a second container holder 40, a bobbin unloader 41, an unwinder 42, the post-treatment chamber 9 and the dryer 10. The unloading carrier 39, second container holder 40, bobbin unloader 41 and unwinder 42 are structurally the same as the loading carrier 15, first container holder 13, bobbin holder 14 and winder 12, respectively, but they are functionally opposite to those units 15, 13, 14, 12 which are provided at the supply side of the apparatus.

The cooling bath 8 retains therein a cooling liquid and is provided with a shower spray 43 for cooling the container 3 which has been transferred from the heating bath by the unloading carrier 39. The unloading carrier 39 further serves to transfer the container 3 from the cooling bath 8 to the second container holder 40. The bobbin 2 on which the treated or dyed textile material is wound is removed from the container holder 40 and then placed on the unwinder 42 by means of the bobbin unloader 41. The dyed textile material is unwound from the bobbin 2 while the latter is rotatably held on the unwinder 41. The thus unwound textile material is then fed into the post-treatment bath 9 which is composed of a J-box 44, a water washing bath 45 and a finishing bath 46 disposed in the order named as viewed from the path of movement of the textile material. The dryer 10 is composed of a pair of vertically arranged heating rollers 47, 47.

As shown in FIG. 1, the apparatus further comprises a dye liquor supply unit 48 disposed above the gripper 17 of the first container holder 13 for supplying a metered amount of dye liquor into the container 3 as the latter is held by the container holder 13. The amount and the kind of the dye liquor 4 are determined by the material and the amount of the textile material 1 to be treated, and the size of the container 3. The apparatus, as shown in FIG. 2, further includes a cover return conveyor device 49 extending between the first and second container holders 13, 40 for returning the cover 5 from the discharge side to the supply side of the apparatus. A container return carrier 50 and a bobbin return carrier 51 are also provided respectively for returning the container 3 and the bobbin 2 from the discharge side to the supply side of the apparatus.

With the apparatus thus constructed, a predetermined amount of elongate textile material 1 is wound on the bobbin 2 while the latter is revolved on the winder 12. The bobbin 2 is detached from the winder 12 and then inserted by the bobbin loader 14 into the container body 3*a* which is held horizontally on the container holder 13. The container holder 13 angularly moves the container body 3*a* into the vertical position in which the container body 3*a* is disposed vertically with its open end facing upwardly. Then, the container body 3*a* is supplied with an adequate amount of dye liquor 4 which is determined by the amount of textile material 1 such that a gaseous phase portion is maintained in the container 3 when it is closed. The dye liquor 4 preferably has a bath ratio of 1:5–1:10. After the open end of the container body 3*a* is closed by the cover 5, the container 3 is angularly moved again to the horizontal position from which the container 3 is transferred by the loading carrier 15 to the inlet end of the heating bath 7. The container 3 is fed either continuously or intermittently by the conveyor device 25 from the inlet end to the outlet end of the heating bath 7 while at the same time the container 3 is rotated about its own axis by the rotating device 26 and is adequately varied in its vertical position to adjust the degree of immersion of the container 3 relative to the heating medium 6. The textile material 1 on the bobbin 2 housed in the container 3 is thus dyed with the dye liquor 4. Then the container 3 is transferred from the heating bath 7 to the cooling bath 8 to cool the dyed textile material 1. Thereafter, the container 3 is removed by the unloading carrier 39 and then held on the second container holder 40. While holding the container in the horizontal position, the cover 5 is detached from the container body 3a, then the bobbin 2 with the dyed textile material 1 wound thereon is removed from the container body 3*a* by the bobbin unloader 41. The thus removed bobbin 2 is set on the unwinder 42 by means of which the dyed textile material 1 is withdrawn from the bobbin 2 into the post-treatment bath 9 for washing and finishing. The thus finished textile material 1 is heated as it runs around the heating rollers 47. The container 3, bobbin 2 and cover 5 which were used for dyeing are washed and returned to the supply side of the apparatus.

Figure 12:
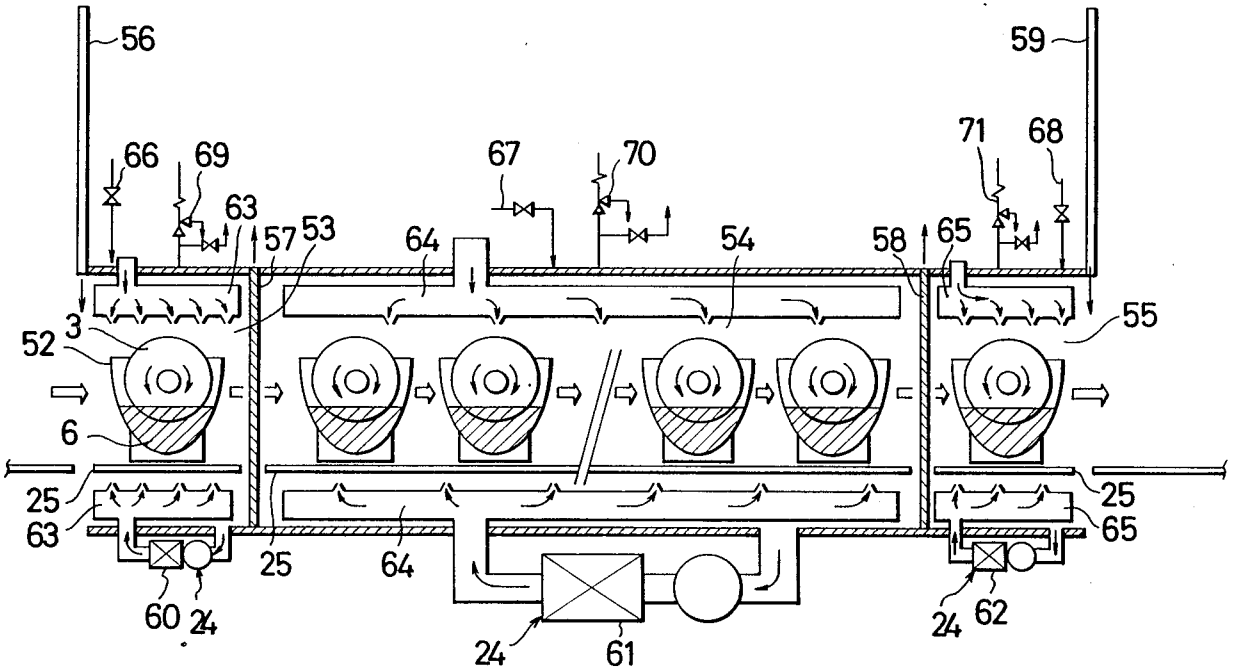
FIG. 12 is a diagrammatic view showing another dyeing apparatus according to the present invention.

A modified treatment apparatus shown in FIG. 12 is of the continuous high-temperature high-pressure type and includes bucket conveyor 25 having a series of buckets 52 each receptive of one container 3. The bucket 52 corresponds to the heating bath 7 of the foregoing embodiment and contains a heating medium 6. A non-illustrated rotating device is incorporated in the bucket 52 for rotating the container 3 which is received in the bucket 52. The bucket 52 is fed through a preheating chamber 53 into a heating chamber 54, then advanced through the heating chamber 54 at a predetermined speed, and finally delivered through a stabilizing chamber 55 to a post-treatment station (not shown). Though not shown, the container 3 retains therein a predetermined amount of textile material wound on a bobbin (identical to the bobbin 2 shown in FIG. 4) and a dye liquor.

The preheating chamber 53 is held at the same temperature as the heating chamber 54 for heating the bucket 52 before the same bucket 52 is fed into the heating chamber 54. Likewise, the stabilizing chamber 55 is held at the same temperature of the heating chamber 54 for setting dyestuff applied to the textile material.

The preheating chamber 53, heating chamber 54 and stabilizing chamber 55 are arranged in series. The preheating chamber 54 has an inlet door 56 and is separated by an interior entrance shutter 57 from the heating chamber 54. The heating chamber 54 is separated by an interior exit shutter 58 from the stabilizing chamber 55 which has an outlet door 59. Each of the chambers 53, 54, 55 is provided with a horizontal conveyor device 25 for advancing the buckets 52, a heating unit 24 composed of a hot air generator 60, 61 or 62 for supplying hot air from upper and lower hot air outlets 63, 64 or 65 into the respective chamber 53, 54 or 55. The preheating chamber 53, heating chamber 54 and stabilizing chamber 55 are held under pressurized condition for which purposes a pressurized air supply unit 66, 67 or 68 and a safety device 69, 70 or 71 are associated with each respective chamber 53, 54, 55. The safety device 69, 70, 71 is composed of a safety valve and a vent hole.

Figure 13:
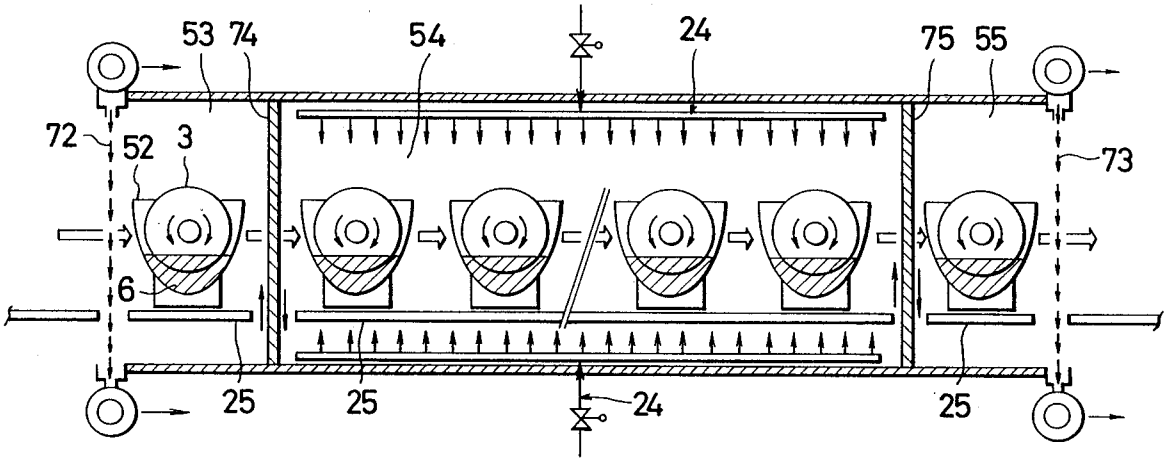
FIG. 13 is a view similar to FIG. 12, showing a modified dyeing apparatus.

FIG. 13 shows a modified treatment apparatus according to the present invention. The apparatus is of the continuous atmospheric steamer type and has a structure substantially the same as the structure of the apparatus shown in FIG. 12 with the exception that the preheating, heating and stabilizing chambers 53–55 are defined jointly by an inlet air curtain 72, a movable interior entrance curtain 74, a movable interior exit curtain 75 and an outlet air curtain 73. Further, the heating device 24 comprising a steam heater is disposed only in the heating chamber 54. The continuous atmospheric steamer type treatment apparatus, as opposed to the continuous high-temperature high-pressure type treatment apparatus shown in FIG. 12, is no longer required to provide a safety device.

Figure 14:
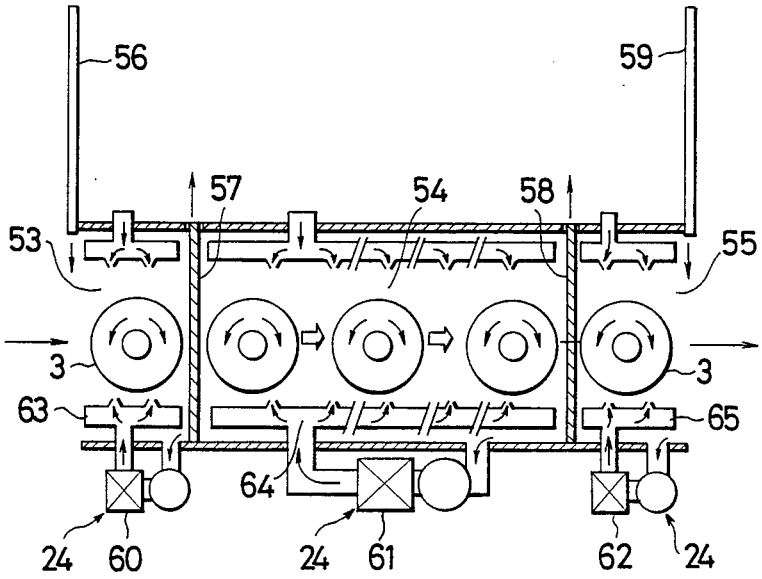
FIG. 14 is a view similar to FIG. 12, showing still another modified dyeing apparatus.

A still modified treatment apparatus shown in FIG. 14 is of the continuous hot air heating type. This apparatus is similar to the apparatus shown in FIG. 12 but differs therefrom in that the containers 3 are fed by a nonillustrated conveyor device through the chambers 53, 54, 55 while being suspended horizontally. At the same time, the containers 3 are rotated by a rotating device, not shown. This apparatus is particularly suitable for the treatment of textile material formed of polyester synthetic fiber.

Figure 15:
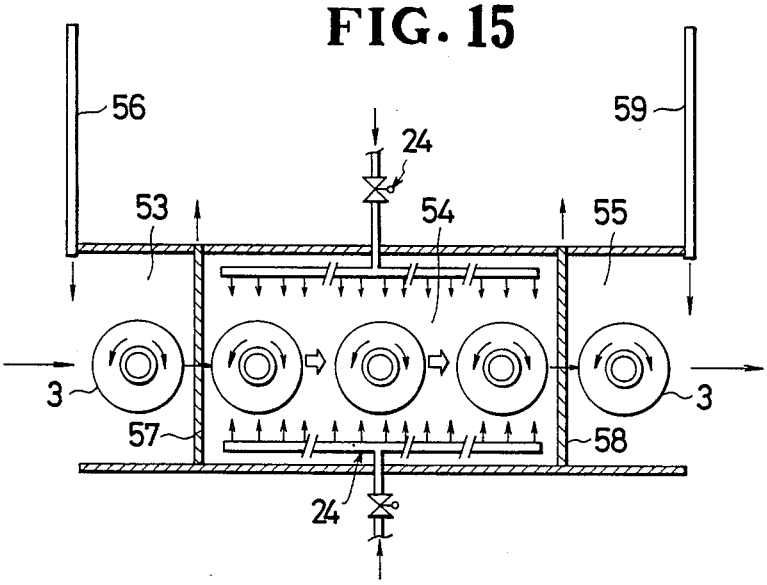
FIG. 15 is a view similar to FIG. 12, showing another form of modification of the dyeing apparatus according to the present invention.

FIG. 15 shows another modified treatment apparatus which is substantially the same as the apparatus shown in FIG. 14, excepting that the heating unit 24 is composed of a steam heater disposed only in the heating chamber 54. With this steam heater 24, the heating chamber 54 is held at the atmospheric pressure. This treatment apparatus is particularly suitable for the treatment of a textile material formed of cotton fiber or nylon fiber.

As described above, an elongate textile material wound on a bobbin and a treatment liquid are enclosed in a container while keeping a gaseous phase portion within the container. The container is rotated as it is fed through an elongate high-temperature zone so that the treatment liquid is heated efficiently at a predetermined temperature. At the same time, the textile material moves alternately through the treatment liquid and the gaseous phase portion within the container as the bobbin rotates in unison with the container with the result that the treatment liquid is distributed uniformly over the entire area of the textile material. This uniform treatment liquid distribution is promoted by stirring the treatment liquid by splushing fins provided on the bobbin. A desired treatment such as dyeing can be carried out for each container and hence the color reproducibility is stable between different lots or batches. Thus, the treatment system of the present invention is particularly suitable for the production of various kinds of textile articles in small quantities.

Obviously, various modifications and variations of the present invention are possible in the light of the above teaching. It is therefore to be understood that within the scope of the appended claims the invention may be practiced otherwise than as specifically described.

What is claimed is:

1. A method of treating an elongate textile material with a treatment liquid, comprising the steps of:

(a) sealingly holding in a container an elongate textile material to be treated which is liquid-permeably wound on a bobbin and a treatment liquid while keeping a gaseous phase portion within the container; and (b) conveying the container longitudinally through an elongate high-temperature treatment zone to heat the treatment liquid at a predetermined temperature while rotating the container together with the bobbin held therein to cause the textile material to move alternately through the treatment liquid and the gaseous phase portion within the container, thereby treating the textile material with the treatment liquid.

2. A method according to claim 1, wherein the high-temperature treatment zone includes an elongate heating bath holding therein a liquid heating medium heated at said predetermined temperature.

3. A method according to claim 2, wherein the container, as it is conveyed through the elongate heating bath, is changed in position relative to the surface of the liquid heating medium to vary the degree of immersion of the container relative to the liquid heating medium, thereby controlling the rate of temperature raise of the treatment liquid.

4. A method according to claim 1, wherein the high temperature treatment zone including an elongate heating chamber holding therein a gaseous heating medium heated at said predetermined temperature.

5. A method according to claim 4, wherein the gaseous heating medium comprises hot air.

6. A method according to claim 4, wherein the gaseous heating medium comprises steam.

7. A method according to claim 4, wherein the high-temperature treatment zone further includes a movable bucket holding therein a liquid heating medium and receptive of the container.

8. A method according to claim 4, wherein the high-temperature treatment zone further includes a preheating chamber disposed at an inlet end of the heating chamber, and a stabilizing chamber disposed at an outlet end of the heating chamber.

9. A method according to claim 1, wherein the treatment liquid is stirred as the bobbin is rotated in unison with the container.

10. A method according to claim 1, wherein a plurality of said containers are conveyed in series with each other.

11. An apparatus for treating an elongate textile material with a treatment liquid, comprising:

(a) a bobbin for winding thereon an elongate textile material and having a liquid-permeable structure;

(b) a container for sealingly holding therein said bobbin and a treatment liquid with a gaseous phase portion kept within said container, said bobbin being immovably held within said container;

(c) means defining an elongate high-temperature treatment zone;

(d) a conveyor device for conveying said container longitudinally through said elongate high-temperature zone for heating said treatment liquid at a predetermined temperature; and (e) a rotating device for rotating the container to cause the textile material to move alternately through said treatment liquid and said gaseous phase portion while said container is being conveyed by said conveyor device.

12. An apparatus according to claim 11, said bobbin having means for stirring said treatment liquid as it is rotated in unison with said container.

13. An apparatus according to claim 11, said bobbin including a pair of circular ring plates and a plurality of support bars extending between and interconnecting said circular ring plates, said container having a cylindrical shape and including a pair of aligned retainer projections extending inwardly from opposite end walls thereof for retaining respectively thereon said ring plates of said bobbin.

14. An apparatus according to claim 13, said support bars being circumferentially spaced at equal angular distances.

15. An apparatus according to claim 13, each said support bar having an angled cross-sectional shape and including at least one longitudinal splushing fin.

16. An apparatus according to claim 11, said container including a generally cup-shaped container body having a concentric support shaft extending outwardly from an end wall thereof, and a circular cover detachably connected to an open end of said cup-shaped container body and having a concentric support shaft extending outwardly away from said support bar of said container body.

17. An apparatus according to claim 16, said container body having at least one reinforcing ring on its outer peripheral surface.

18. An apparatus according to claim 11, said high-temperature treatment zone defining means comprising an elongate heating bath holding therein a liquid heating medium heated at said predetermined temperature.

19. An apparatus according to claim 11, said high-temperature treatment zone defining means comprising an elongate heating chamber holding therein a gaseous heating medium heated at said predetermined temperature.

20. An apparatus according to claim 19, said gaseous heating medium comprising hot air.

21. An apparatus according to claim 19, said gaseous heating medium comprising steam.

22. An apparatus according to claim 11, said container having a cylindrical shape, said conveyor device comprising a crane disposed above and movable along said elongate high-temperature treatment zone and supporting said container in horizontally suspended condition.

23. An apparatus according to claim 11, said container having a cylindrical shape and including a pair of aligned support shafts projecting outwardly from opposite end walls of said cylindrical container, said conveyor device comprising a pair of endless belt conveyors disposed on and extending along opposite sides of said elongate high-temperature treatment zone and supporting thereon said support shafts of said container.

24. An apparatus according to claim 11, said container having a cylindrical shape and including a pair of aligned support shafts projecting outwardly from opposite end walls of said cylindrical container, said conveyor device comprising a pair of lifters disposed on and movable along said elongate high-temperature treatment zone and vertically movably supporting thereon said support shafts, respectively, of said container.

25. An apparatus according to claim 11, said conveyor device including a bucket conveyor having a series of buckets each containing a liquid heating medium and receptive of one container.

26. An apparatus according to claim 11, said container having a cylindrical shape, said rotating device including at least one power-driven friction roller frictionally engageable with an outer peripheral surface of said cylindrical container for rotating said container.

27. An apparatus according to claim 26, further including a free-rotating friction roller engageable with said outer peripheral surface of said cylindrical container, said power-driven friction roller and said free-rotating friction roller being disposed on opposite side of said container and horizontally movable to adjust the vertical position of said container.

28. An apparatus according to claim 26, said container having a reinforcing ring on its outer peripheral surface, said reinforcing ring being engageable with said friction roller.

29. An apparatus according to claim 11, said container having a cylindrical shape, said rotating device comprising a power-driven drive gear and a driven gear held in mesh with said drive gear and secured concentrically with said container.

30. An apparatus according to claim 11, including a plurality of said containers, said plurality of containers being arranged in series with each other.

* * * * *